US006491792B2

(12) United States Patent
Shakespeare et al.

(10) Patent No.: US 6,491,792 B2
(45) Date of Patent: Dec. 10, 2002

(54) APPARATUS FOR CONTROLLING A HEADBOX IN A PAPER MACHINE

(75) Inventors: John Francis Shakespeare, Siuro; Juha Antero Kniivilä , Tampere; Petri Nyberg, Jyväskylä, all of (FI)

(73) Assignee: Metsuo Paper, Inc., Heksinki (FI)

( * ) Notice: Subject to any disclaimer, the term of this patent is extended or adjusted under 35 U.S.C. 154(b) by 0 days.

(21) Appl. No.: 09/908,264

(22) Filed: Jul. 18, 2001

(65) Prior Publication Data

US 2002/0011319 A1 Jan. 31, 2002

Related U.S. Application Data

(62) Division of application No. 09/014,430, filed on Jan. 26, 1998, now Pat. No. 6,284,100.
(60) Provisional application No. 60/036,602, filed on Jan. 29, 1997.

(30) Foreign Application Priority Data

Jan. 24, 1997 (FI) ..... 970294

(51) Int. Cl.[7] ..... D21F 7/06

(52) U.S. Cl. ..... 162/263; 162/198; 162/DIG. 10; 162/DIG. 11; 162/183; 162/212; 162/252; 162/259; 162/253; 162/262; 162/336; 364/471; 364/469

(58) Field of Search ..... 162/198, DIG. 10, 162/DIG. 11, 183, 212, 216, 252, 259, 263, 253, 262, 336; 364/471, 469

(56) References Cited

U.S. PATENT DOCUMENTS 5,674,363 A * 10/1997 Huovilla et al. ..... 162/216
5,888,348 A * 3/1999 Hampl ..... 162/139

* cited by examiner

*Primary Examiner*—Steven P. Griffin
*Assistant Examiner*—Mark Halpern
(74) *Attorney, Agent, or Firm*—Steinberg & Raskin, P.C.

(57) ABSTRACT

Method and apparatus for controlling the mixing proportions of feed streams being supplied to a headbox, using devices for sampling two or more of the feed streams upstream of the headbox and devices for measuring concentration of constituents in or other properties of those samples. A method of regulating one or more properties of a moving web, and especially a paper web during manufacture, employing the aforesaid method and apparatus are also disclosed.

11 Claims, 13 Drawing Sheets

APPARATUS FOR CONTROLLING A HEADBOX IN A PAPER MACHINE

CROSS-REFERENCE TO RELATED APPLICATION

The present application is a divisional application of U.S. patent application Ser. No. 09/014,430 filed Jan. 26, 1998, now U.S. Pat. No. 6,284,100 which claims benefit of Provisional Application 60/036,602 filed Jan. 29, 1997.

FIELD OF THE INVENTION

The present invention relates to a method of controlling one or more cross-direction property profiles of a paper web manufactured by a paper machine, which method employs a control system for regulating a headbox or headboxes of the paper machine and in which method the property profile(s) is/are measured by a measurement system. A measurement signal obtained from the measurement system is supplied to the control system. Each headbox is supplied with at least two feed streams which contain feedstuffs for the paper to be manufactured suspended in aqueous solution and which feed streams are divided into feed zones in cross-machine sections of the headbox, the feed zones each being supplied with combinatory streams of the feed streams.

In addition, the present invention relates to apparatus for controlling one or more cross direction property profiles of a paper web manufactured by a paper machine, which apparatus comprises a control system for regulating a headbox or headboxes of a paper machine, a measurement system for measuring each property profile, means for feeding a measurement signal obtained from the measurement system to the control system, means for supplying at least two feed streams to each headbox, which feed streams contain feedstuffs for the paper to be manufactured in aqueous solution, and means for dividing the feed streams into feed zones in cross-machine sections of each headbox, which feed zones are each supplied with combinatory streams of the feed streams.

BACKGROUND OF THE INVENTION

As is known in the prior art, systems for controlling the cross-direction grammage of paper manufactured by paper machines operate in the following manner. The flow of thickstock coming into a wire pit of a paper machine is regulated by a grammage valve based on grammage measurement at the dry end of the paper machine. The grammage of the paper web is measured by means of measuring sensors traversing in a cross direction thereof, and the measurement result of the cross-direction grammage profile is averaged and passed as a feedback signal of a control system. The flow of thickstock is passed from the grammage valve, as known in prior art, to the wire pit, into which white water from the wire section of the paper machine is also passed. The thickstock flow and white-water are mixed in the wire pit and the thus-obtained diluted stock flow is passed, as known in itself, through pulp cleaning and deaeration devices to an inlet header of a headbox and therefrom, further through a distribution tube bank of the headbox, possibly through an equalization chamber and a turbulence generator to a slice channel of the headbox. A pulp suspension jet is discharged from the slice channel onto a forming wire or into a forming gap defined between forming wires.

In the prior art, the cross-direction grammage profile of paper manufactured by paper machines may be regulated by profiling the height of a slice opening in a headbox based on the aforesaid grammage measurement at the dry end of the paper machine. Recently, so-called dilution regulations have also become more common in which dilution water, usually white-water or a stock that is more dilute than the headbox stock, is supplied to individual feed points situated in the cross-direction in connection with a headbox. This dilution water feed system serves to profile the cross-direction grammage profile of a slice jet together with the regulation of a profile bar, or without it. A special advantage of dilution regulation is that the headbox can be operated with a slice opening having a uniform height so that the cross-direction flows in the slice jet and after it, caused by the profiling of the height of the slice opening, as well as distortions of the fiber orientation profile of paper resulting from them, may be avoided.

Prior-art dilution headboxes are subdivided into several feed zones across the headbox. Additionally, there may be more than one layer of such feed zones. Two or more streams of feedstuff supply each layer of feed zones, and each stream of feed stuff may supply one or more layers of feed zones. Each feed zone in each layer is equipped with means for controlling the combinatory proportions of streams fed to that feed zone, normally using a suitable valve arrangement. Additionally, there may be one or more layers of feed zones which are supplied by only one feed stream, or are supplied by plural feed streams without means for controlling combinatory proportions of feed streams fed to each feed zone.

Commonly, two feed streams are provided, one supplying the main feedstuff, and the other supplying a feedstuff of different properties. Normally, the second stream is more dilute than the main stream, but this need not always be so. The dilute feedstuff is normally white-water taken from the wire pit or short circulation, often with some processing, such as deaeration, cleaning, or filtration. The main feedstuff also normally contains white-water, to which a thickstock is added. In some cases, clarified water may be used instead of white-water as the dilute feedstock.

More than two feed streams may be provided, where each feed stream supplies feedstuffs of different material composition. For instance, both white-water and clear water streams may be supplied as well as the main feedstuff stream. Alternatively, two main feed streams may carry different feedstuffs, with a third feed stream carrying a dilute feedstuff. However, it is also possible that more than one stream contains the same feedstuff, in this case, all streams carrying an identical feedstuff are treated as a single consolidated stream for the purposes of the invention described below. Applicability of this invention requires that not all streams carry exactly the same feedstuff, as described more fully below.

The streams fed to each feed zone are mixed together in any of several ways in the feed zone, producing an aggregate stream. The aggregate streams from all feed zones are merged, forming a single jet discharged across the whole headbox. There may be some mixing between streams in adjacent feed zones in this merging.

An example of a dilution headbox is the Valmet Sym-Flo D™.

With respect to different details of structures of dilution headboxes, reference is made to the following patents and patent applications: Finnish Patent No. 92229 (corresponding to European Patent Application No. 0 633 352 and U.S. Pat. No. 5,674,363) and U.S. Pat. No. 5,560, 807.

In some cases, multiple conventional (non-dilution) headboxes may be operated as if their combination formed a dilution headbox. This is possible if the headboxes do not all have the same feed streams, and there is a difference in composition between some of the feed streams being fed to the individual headboxes. In this case, modulating the slice lip profiles has the effect of changing the combinatory proportions of the feed streams at each location across the web. However, the streams are not mixed, so the effect is similar to operation of a multilayer dilution headbox.

Feedstuffs, White-water Retention

It should be noted that the feedstuffs used in the paper industry are of complex composition, containing many distinct material components suspended in an aqueous solution. The principal material components are fibers of different kinds, with properties which depend on the fiber source (Norway spruce, silver birch, Eastern hemlock, bagasse, kenaf, etc.), and pulping process used. Resins and synthetic polymers, as well as various clays, minerals (ash), and other inorganic material may be added. Substances such as dyes, brighteners, anti-brighteners, bleaches, and opacity agents may occur in quantities which have negligible effects on the weight, strength, or other material properties of the web, but which have major effects on color, brightness, opacity, and other optical properties of the web. There may also be solutes dissolved in the aqueous solution, affecting its pH and other chemical properties, thus modulating the effect of other feedstuff components on properties of the web.

As known in the prior art, when initially forming a paper web, the aqueous solution is drained through porous fabric (the "wire" of a forming section) into the wire pit, as white-water, leaving much of the suspended material to substantially form the web. The white-water at each section of the wire contains substantially the same suspended components as the jet above it, but in lesser concentrations. Normally, white-water is combined from all sections of the wire into a single stream. When several forming units are used, as in manufacture of a multi-layer web, the white-water streams from each forming unit may be kept separate in the process, or may be merged into a composite white-water stream.

The fraction of each component suspended in the jet which remains in the web is referred to as the "retention" of that component. Different components can have greatly differing retentions, and the retentions of some components is affected by chemical properties of the aqueous suspension (such as pH), and by concentrations of other components (such as polymers). Thus, the white-water varies in its component concentrations differently to the jet. Moreover, the retention of each component can vary differently with process conditions.

The retention of each component generally increases if the web is made heavier, but to different extents. Since properties such as weight may vary across the web, and since the composition of the jet can vary across the web, the retention of each component in the jet can also vary across the web. As the white-water from the wire pit is a mixture of white-water drained from all locations across the machine, only the average retention can be inferred from concentration measurements in the feed streams to a headbox.

Some paper machines make only a few grades of paper, and employ substantially the same feedstuffs under substantially similar process conditions whenever a particular grade is being manufactured. Under these circumstances, each grade likely has a characteristic narrow range of retentions, and there is little variation in concentrations of the main feedstock or the white-water.

More commonly, paper machines make a variety of grades from feedstuffs of diverse properties, and adjust process conditions accordingly. Under these circumstances, retention of each component can vary greatly within a single grade, and across grades. Similarly, white-water concentrations can vary differently for each component, both within and across grades. Large variations can occur over short times within a single grade.

Recycled fiber tends to be more variable in properties than new fiber, and its use is increasing in many paper machines. Use of a paper machine's repulped off-specification production (broke) varies from time to time, even in single grade machines.

Thus, the plural feed streams to a dilution headbox normally contain different concentrations of each feedstuff component. In general, the ratio of concentrations of a component in the several feed streams is different for each component. In particular, a white-water feed stream will be relatively richer in solutes and fine suspended solids than in fibers, and relatively richer in short fibers than in long fibers, when compared to the main feed stream.

Feedstuff Property Measurements

The physical and chemical properties of the major feedstuff components exhibit considerable variation. This is partly due to their natural origin, and partly due to variations in processing. These component variations, together with variation in blending of components to form a feedstuff, cause variation in the properties of feedstuffs. Variation in the operation of the short circulation of the paper machine can be a further cause of feedstuff property variation.

Until recently, it was laborious to perform more than a superficial laboratory analysis of concentrations and other properties of typical paper industry feed streams. Accordingly, paper mill laboratories measured only a total retention, and the practice in the paper industry is to treat retention as a single quantity. More sophisticated laboratory instruments are now available, but due to remoteness from the process and other practical concerns, analyses of headbox feed streams are infrequent. Moreover, a laboratory analysis is unlikely to be sufficiently timely for control purposes when retention is varying.

Devices which measure viscosity or freeness as an analogue of consistency (an aggregate concentration of suspended solids) have been available for many years, but have been of mediocre reliability and accuracy. The technology underlying such devices is also unsuited to low consistency regimes, such as those encountered in feed streams to the headbox. Accordingly, such devices have seldom been installed in headbox feed streams, and are not employed in cross machine control of dilution systems.

Newer, more sophisticated measurement devices are suitable for continuously and rapidly measuring concentrations of low consistency streams. These are capable of measuring distinct component concentrations, or distinct aggregate concentrations of groups of components (such as total ash concentration or total fiber concentration) as well as, or instead of measuring the total consistency.

An example of such a concentration measurement device is the device marketed by the trademark Kajaani RM-200™.

In addition to concentration, instruments are available for on-line measurement of other feed stream properties such as color and brightness of a sample, and for measuring the distribution of fiber lengths in a sample.

Other factors, such as pH or temperature, may determine the extent to which a feedstuff property affects web properties. Devices for measuring pH, various solvated ionic species (as pNa, pK, etc.), or temperature are commonly available, including some suitable for use in headbox feed streams.

Web Property Measurement and Control

Many properties of the moving web can be measured during manufacture of paper. Commonly, a paper machine is equipped with a number of measurement devices which traverse the moving web at one or more locations on the paper machine. Alternatively, an array of sensors may be deployed across the web, or stationary sensors may remotely measure properties across the web. Typical properties measured are basis weight, water weight, ash weight, caliper, gloss, brightness, opacity, fiber orientation, and strength. Some of these properties may be measured in greater detail, such as distinguishing between different species of ash ($Al_2O_3$, $CaCO_3$, $SiO_2$, $TiO_2$, etc.), or different resins. Other properties, such as dry weight, fiber weight, or percent moisture may be derived from these measurements.

These web property measurements are made in each of several subdivisions of the web in the cross machine direction, presented as a "profile" across the web. With modern measurement systems, the web subdivisions may be less than 1 cm in width. A control system for regulating the plural values of such a profile property commonly provides a means for entering the desired shape of the profile. Moreover, there may be several properties, each with a different desired profile shape.

Moreover, properties of the suspension discharged from the headbox may be measured during formation of the web on the wire. Such measurements should also be construed as web property measurements in the context of this invention, provided a property is measured at plural locations in the cross machine direction.

The ability to control the combinatory proportions of feed streams at each feed zone allows properties of the web to be controlled during manufacture. A change in combinatory proportions at all feed zones across the headbox can affect one or more properties of the web at all locations across the web. A change in combinatory proportions at a single feed zone can affect one or more properties of the web over a portion of the web. The width of the affected portion of the web may not correspond to the width of the feed zone, and the effect may be unevenly distributed in magnitude or sign within the affected portion of the web. When more than one property is affected, the effect on each property may be differently distributed over portions of the web which may differ in width and location.

The effect on a material property of the web, such as ash weight, of changing the combinatory proportion of feed streams depends on the different concentrations within those streams of each component which influences that property.

The effect on other properties of the web, such as color or opacity, depends both on material properties of the feed streams, and on non-material properties, such as brightness. The retention of each feed stream component over the affected portion of the web may also affect the magnitude of the effect, and this retention may be influenced by several measurable properties of the feed streams, such as pH or temperature.

A control system can more effectively modulate the combinatory proportions of the feed streams if it can more accurately model the process effect of such modulation on each of the properties to be regulated. Such modeling requires that the appropriate feed stream properties are measured, and that the dependencies between feed stream properties and web properties be substantially known. Many such dependencies are common knowledge.

Since the plural feed streams to a dilution headbox contain different relative amounts of the various feedstuff components, and since each feedstuff component affects one or more web properties to various extents, it is evident that changing the combinatory proportions of the feed streams can have tangible and dissimilar effects on plural web properties.

For example, if a dilution headbox utilizes two feed streams, one carrying white-water and the other carrying the main stock, the fiber in the web is supplied predominantly by the main stock stream, but the ash may be supplied in similar degree by both streams. Thus, changing the combinatory proportions of the feed streams at one or more feed zones will clearly affect the web fiber and ash profiles differently.

Nowadays, control systems exist which can effectively modulate one or more cross machine actuator systems to regulate one or more property profiles. The regulation of web properties can be enhanced by providing suitable measurements of properties of the plural feed streams to a control system, and utilizing process models which relate changes in web properties to the combinatory proportions of feed streams and to the properties of the feed streams.

An example of such a control system is the Valmet Damatic XD™.

Regarding prior-art control systems of a paper machine, reference is also made by way of example to U.S. Pat. No. 5,381,341 (corresponding to European Patent No. 0 401 188 and Finnish Laid-Open Publication No. 85731).

Introductory Summary

The salient points of the above discussion can be summarize as follows:

- The plural feed streams to a dilution headbox contain different relative amounts of the various feedstuff components, and differ in other properties such as color, brightness, pH, temperature, etc.
- Each feedstuff component affects one or more web properties to various extents. Web properties are also affected by other properties of the feedstuffs, such as color, brightness, pH, temperature, etc.
- Changing the combinatory proportions of the feed streams can have tangible effects on plural web properties. The extent to which a web property is affected by a change in the combinatory proportions of feed streams depends on the properties of those feed streams.
- By deploying suitably accurate and reliable measurements of concentration or other pertinent properties of the feed streams to a dilution headbox, a control system can better regulate one or more property profiles of the web, by modulating the combinatory proportions of the feed streams at each feed zone of a dilution headbox.

The last of these points leads to the present invention.

OBJECTS AND SUMMARY OF THE INVENTION

An object of the invention is to allow more accurate and faster control of properties of the paper web, by means of a novel arrangement of devices, and exploiting the benefits of that arrangement.

Another object of this invention is to take advantage of several recent technologies in combination, including development of dilution headboxes, concentration measurement devices suited to the paper industry, and the potential for advanced control strategies in modern control systems.

With a view to achieving the objects stated above and others, in the method in accordance with the invention, a property, such as concentration and/or consistency and/or brightness and/or color and/or equivalent, of one or more feedstuffs of the feed streams is measured, a measurement signal is generated based thereon, and the thus-obtained measurement signal is fed to a control system. Based on the measurement of the property and the profile thereof, and setpoint values or equivalent, control signals are formed by the control system for regulating an actuator or an actuator combination situated at each feed zone of the headbox or headboxes. By means of the actuator or actuator combination, combinatory proportions of different feed streams supplied to the feed zone in question are affected to achieve a desired property profile or profiles of the web.

The apparatus in accordance with the invention comprises:

means for sampling continuously or at intervals each of two or more feed streams supplied to a headbox or headboxes;

means for measuring properties of the feed streams, such as, concentrations of constituents in and/or brightness of and/or color of the samples;

regulation means for regulating combinatory proportions of the feed streams at each of a plurality of feed zones of the headbox or headboxes in a cross direction thereof; and means for supplying the measurements of properties of the feed streams or factors calculated therefrom to the regulation means responsive to one or more measured properties of the paper web and modulating the aforesaid combinatory proportions to regulate the aforesaid properties of the paper web.

In this invention, means are provided for sampling, continuously or at intervals, the material in each of two or more of the feed streams to a headbox which is equipped with means for controlling combinatory proportions of those feed streams at each of plural feed zones across the headbox, means are provided for measuring properties such as the concentrations of constituents in these samples, and means are provided for supplying those measurements or factors calculated therefrom to any regulatory means responsive to one or more measured properties of the web and modulating the aforesaid combinatory proportions to regulate the aforesaid properties.

Thus, one of the novelties of this invention is in the use of means for sampling two or more different feed streams to a headbox which is so equipped, together with means for measuring properties such as the concentrations of constituents of those samples, together with means for supplying those measurements or factors calculated therefrom to a means for regulating properties of the web during manufacture.

The benefits of this invention include more effective modulation of the combinatory proportions of the feed streams by any regulatory means responsive to one or more properties of the web, where such means includes modulation of the combinatory proportions of the feed streams at each of several feed zones across a headbox. The importance of this benefit is greatest in situations where one or more of the feed streams undergoes, or is likely to undergo a change in concentration of one or more of its constituents, or a change in brightness or color, or a change in another measured property, such changes occurring either continuously or intermittently, and in diverse amounts.

The feed stream property measurements are used to calculate the effective proportionality factors between changes in the combinatory proportions of the feed streams and changes in properties of the web which are influenced by these feed stream properties and combinatory proportions. Such effective proportionality factors may be for changes in the average combinatory proportions of the feed streams across the headbox, and may also or alternatively be for changes in the local combinatory proportions in each feed zone of the headbox. Such effective proportionality factors may be for the change in the average of a property across the web, or for the local property at each of several subdivisions of the web across the machine, where such subdivisions normally correspond substantially to the feed zones, but may alternatively correspond to narrower or broader subdivisions of the sheet.

Normally, each feed stream to the headbox is sampled, or such streams are sampled as are combined to substantially form each feed stream. However, it is not necessary to measure each property in all feed streams, since it may be known that a particular property is negligibly present or invariable in some feed streams. Similarly, it is possible that some feed streams may be unsampled, and have no property measurements. For example, if a feed stream supplies fresh clear water, it is unnecessary to measure the amount of fiber present in the stream, since the stream is a priori known to contain none. Similarly, if a stream is formed by dosing a colorant of substantially known hue and intensity into a stream of substantially known color, and the dosing ratio is regulated and known, it is unnecessary to measure the color of the resulting stream, as its color can be calculated ab initio from known quantities.

Each means for sampling a stream may be situated at any convenient point in the stream. In the case that more than one means for measuring a concentration or other property is supplied with a sample from a stream, a means for sampling the stream may be provided for each means for property measurement, or a means for sampling the stream may be shared among several means for property measurement.

The means for measuring concentration or other property may be one or more instruments attached permanently, periodically, or intermittently to a means for sampling a stream, or may be one or more instruments remote from the means for sampling the streams, and to which samples must be brought. Additionally or alternatively, a means for sampling a stream may be integral to a means for measuring concentration or other property, including cases where the sampling of the stream takes place within the stream, by exposure within the stream of an element of the means for property measurement. A means for sampling the streams may be autonomous or manually operated, and a means for measuring properties of a sample may be autonomous or manually operated. A means for measuring sample properties may be a laboratory procedure, carried out manually or mechanically.

Each means for measuring concentration may be responsive to the individual concentration of one or more constituents of the sample of the stream, or may be responsive to one or more aggregate concentrations of combined constituents of the sample of the stream, or may be responsive to both individual and aggregate concentrations. The measured concentrations are commonly for constituents such as a particular fiber type or a particular chemical species, or aggregates of constituents such as total fiber or total ash content. Each means for measuring other properties may be responsive to one or more optical properties, such as brightness or color, or may be responsive to one or more thermal or mechanical properties, such as viscosity, or may be responsive to chemical properties, such as pH, or to other properties, such as conductivity or magnetic reluctance. In practice, a single instrument may provide measurements of several properties, which may include concentration, optical, electromagnetic, thermal, mechanical, and chemical properties.

BRIEF DESCRIPTION OF THE DRAWINGS

In the following, the invention is described in detail with reference to some exemplifying embodiments of the invention illustrated in the figures of the accompanying drawing, to the details of which embodiments the invention is in no way narrowly limited.

DETAILED DESCRIPTION OF THE DRAWINGS

Figure 1:
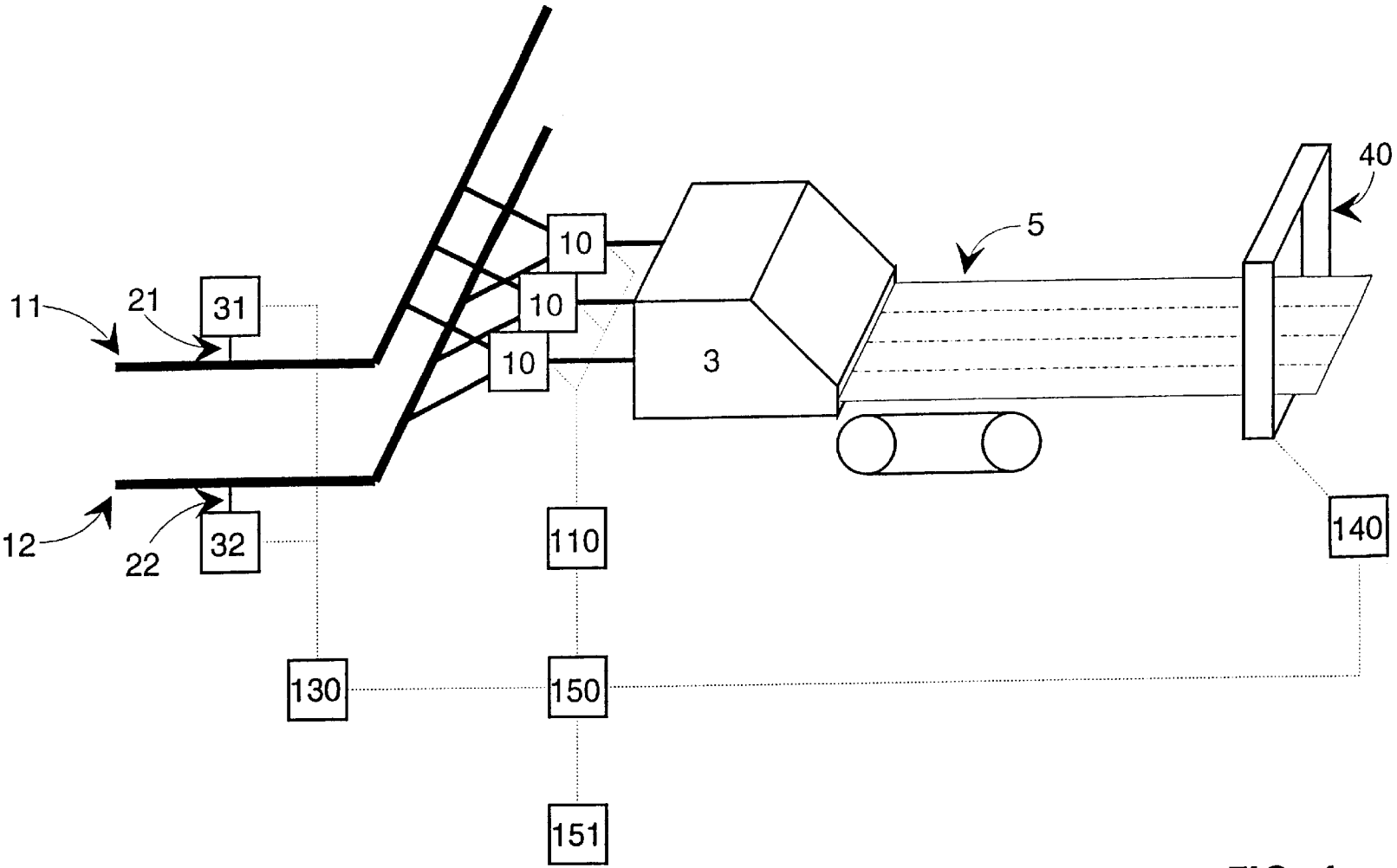
FIG. 1 schematically illustrates a basic embodiment of the invention.

Referring to the accompanying drawings wherein like reference numerals refer to the same or similar elements, FIG. 1 schematically depicts an embodiment of the invention where a dilution headbox 3 is provided with two feed streams 11 and 12. One stream 11 supplies a stock suspension, while the other 12 supplies a feedstuff of different properties than the stock suspension. The two feed streams 11, 12 feed each of a plurality of feed zones defined in the headbox 3 through a means of combining flows 10, normally a suitable arrangement of valves. The means 10 for combining flows to the headbox feed zones are regulated by a computer or other control instrument 110 which can communicate with other computers or instruments. Each feed stream 11, 12 is equipped with a stream sampling arrangement 21, 22, and these stream sampling arrangements are connected to devices 31, 32 which measure one or more concentrations or other properties of the streams. The feed stream property measurement devices 31, 32 are connected to a computer or other control instrument 130 which can communicate the measured properties or factors calculated therefrom to other computers or instruments. The headbox discharge forms a paper web 5, which moves along the machine.

A measurement device 40, commonly a frame with a traversing sensor platform, is arranged in connection with the machine and measures one or more properties of each subdivision of the web 5 as it passes the device 40. This device 40 is connected to a computer or other control instrument 140 which can communicate with other computers or instruments. A control system 150 communicates with the feed zone regulating computers or instruments 110, with the feed stream property measurement computers or instruments 130, and with the web property measurement computers or instruments 140. The control system 150 regulates one or more web property profiles supplied by the web measurement system 140 by modulating the combinatory proportions of the two feed streams 11, 12 at each feed zone, by means for the feed zone regulating computers or instruments 110, which may be an actuation system, and employs in its control calculations the feed stream property measurements or factors calculated therefrom, supplied by the stream measurement system 130 for both of the streams 11, 12. A means 151 is normally provided to furnish information from the control system to a human operator, and for the operator to enter commands and values to the control system, i.e., a keyboard and display.

The number of feed zones may be greater than three, and the feed zones may be of equal or unequal capacity and characteristics. It is not necessary for all means of combining flows to be identical, and not all need be modulated by the web property profile regulator, although preferably at least three are so modulated. The various measurement and control systems may be embodied in a greater or lesser number of elements than shown. There may be plural means 151 for interaction with human operators, or none, and such plural means may be similar or dissimilar.

Note that the number of feed zones shown in FIG. 1 is three, but the embodiment includes greater numbers of feed zones, of equal or unequal flow capacity and evenly or unevenly distributed across the headbox. Note that the salient functions of the various systems may in practice be combined in a lesser number of distinct units, or divided among a greater number of units. Note also that the concentrations or other properties of the feed streams are used in the control calculations for regulating web properties by modulating combinatory proportions, i.e., the combinations or component proportions, of feed streams in each feed zone of the headbox.

Figure 2C:
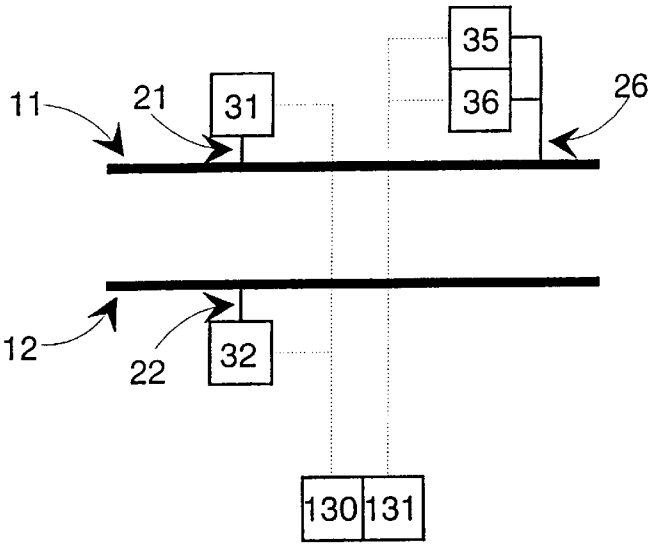
FIGS. 2*a*, 2*b*, and 2*c* schematically illustrate some variant arrangements for parts of FIG. 1.
Figure 2A:
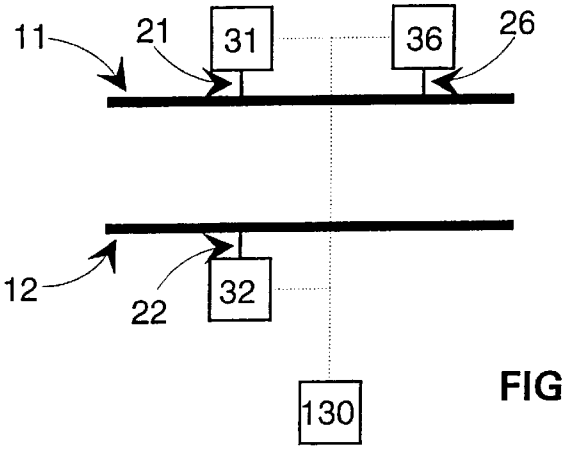

FIG. 2*a* schematically depicts a variation of the embodiment presented in FIG. 1, and described above. In this variation, a feed stream 11 has two sampling arrangements 21, 26, each with a single device for measuring stream properties 31, 36. These devices 31, 36 are connected to a computer or other instrument 130 capable of communicating with other computers or control instruments. The control system 150 employs in its control calculations the feed stream property measurements or factors calculated therefrom, supplied by the stream measurement system 130 for all three of the stream measurement devices 31, 32, 36.

Figure 2B:
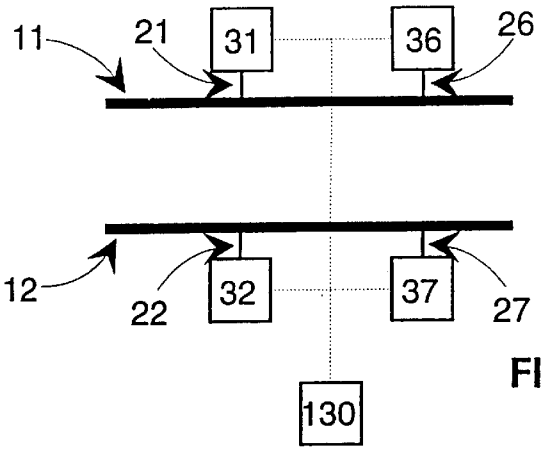

FIG. 2*b* schematically depicts another variation of the embodiment presented in FIG. 1, and described above. In this variation, both feed streams 11, 12 have two sampling arrangements 21, 22, 26, 27, each with a single device for measuring stream properties 31, 32, 36, 37. These devices are connected to a computer or other control instrument 130 capable of communicating with other computers or instruments. The control system 150 employs in its control calculations the feed stream property measurements or factors calculated therefrom, supplied by the stream measurement system 130 for all four of the stream measurement devices 31, 32, 36, 37.

FIG. 2*c* schematically depicts another variation of the embodiment presented in FIG. 1, and described above. In this variation, two property measurement devices 35, 36 are connected to one of the sampling arrangements 26. These devices are connected to a computer or other control instrument 131 capable of communicating with other computers or instruments. The control system 150 employs in its control calculations the feed stream property measurements or factors calculated therefrom, supplied by both stream measurement systems 130, 131 or the four stream measurement devices 31, 32, 35, 36.

Figure 3:
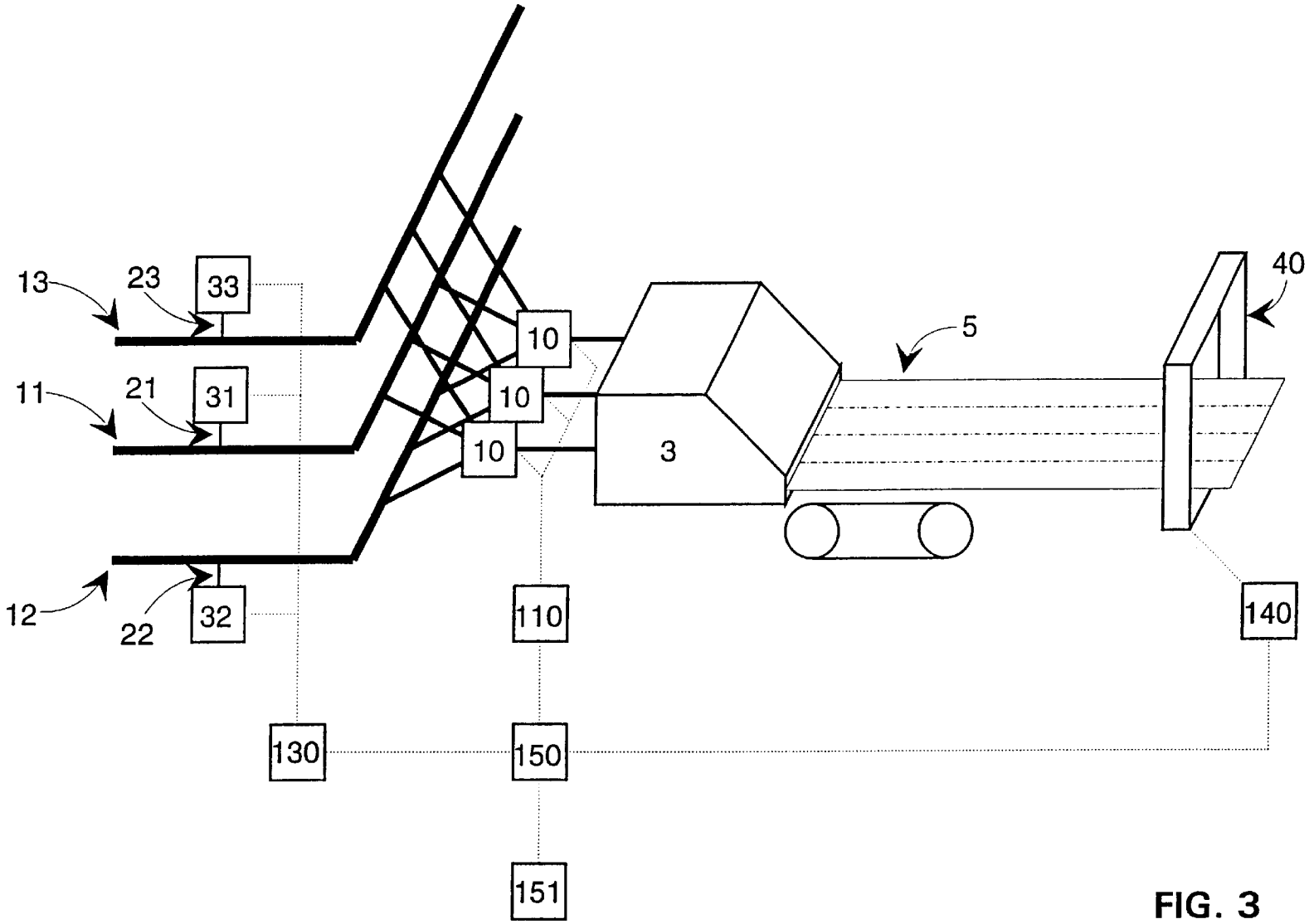
FIG. 3 schematically illustrates another embodiment of the invention, in which a third feed stream is supplied to the headbox.

FIG. 3 schematically depicts a variation of the embodiment presented in FIG. 1, and described above. In this embodiment, three feed streams 11, 12, 13 are fed to each feed zone of the headbox, and each feed zone of the headbox 3 has means 10 suitable for modulating the flow proportions from the three feed streams 11, 12, 13. A sampling arrangement 23 for the third stream 13 is connected to a feed stream property measurement device 33, which is connected to a computer or other control instrument 130 capable of communicating the measurements to other computers or instruments. The control system 150 regulates one or more profiles supplied by the web measurement system 140 by modulating the combinatory proportions of the three feed streams at each feed zone of the headbox, by means of the actuation system 110, and employs in its control calculations the feed stream property measurements or factors calculated therefrom, supplied by the stream measurement system 130 for each of the three streams 11, 12, 13.

Figure 4:
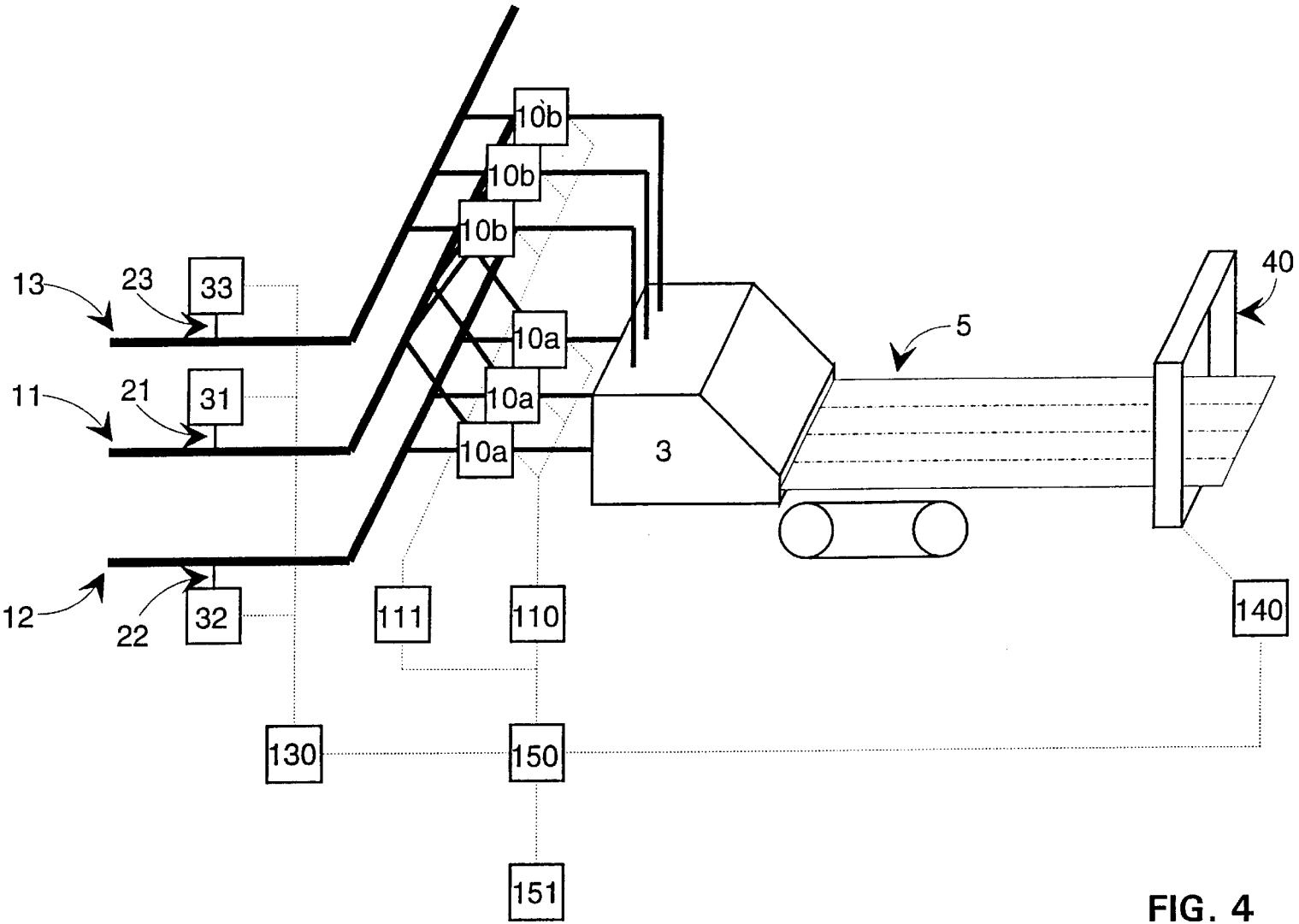
FIG. 4 schematically illustrates another embodiment of the invention, in which there are two layers of feed zones in the headbox, with independent modulation of combinatory proportions in each layer.

FIG. 4 schematically depicts a variation of the embodiment presented in FIG. 1, and described above. In this embodiment, three feed streams 11, 12, 13 are fed to a dilution headbox 3 equipped with two layers of independently modulated feed zones. One feed stream 13 supplies the upper layer only, another feed stream 11 supplies both layers, and the third feed stream 12 supplies the lower layer only. The combinatory proportions in each feed zone in each of the two layers of feed zones of the headbox are modulated using a means for combining flows 10*a*, 10*b* for each layer, such as a suitable arrangement of valves. The means for combining flows 10*a*, 10*b* to the headbox feed zones in both layers are regulated by a computer or other control instrument 110, 111 capable of communicating with other computers or instruments. The control system 150 regulates one or more web property profiles supplied by the web measurement system 140 by modulating the combinatory proportions of the feed streams at each feed zone of each layer, by means of their feed zone regulating computers or instruments 110 (e.g., an actuation control system), and employs in its control calculations, the feed stream property measurements or factors calculated therefrom, supplied by the stream measurement system 130 for the three stream measurement devices 31, 32, 33. Additionally, the control system 150 may similarly modulate the combinatory proportions of layers, either of entire layers or of subdivisions of layers.

The number of feed layers may be greater than two, and not all layers need have a means for combining flows to their feed zones. Also, not all layers which have means for combining flows to their feed zones need be modulated by the web property profile regulator. The means for combining flows to feed zones in a layer may be of equal or unequal capacity and characteristics. The number and character of feed zones and associated means may differ between layers, but preferably at least one layer should have at least three means for combining flows, where such means are modulated by the profile regulator.

The embodiment of FIG. 4 may be generalized to more than two layers, of equal or unequal characteristics. The number of feed streams to feed zones may differ between layers. Each feed stream may feed one layer or more than one layer. More than one feed stream may convey the same feedstuff, provided at least one layer of feed zones is supplied with two or more different feed streams.

Figure 5:
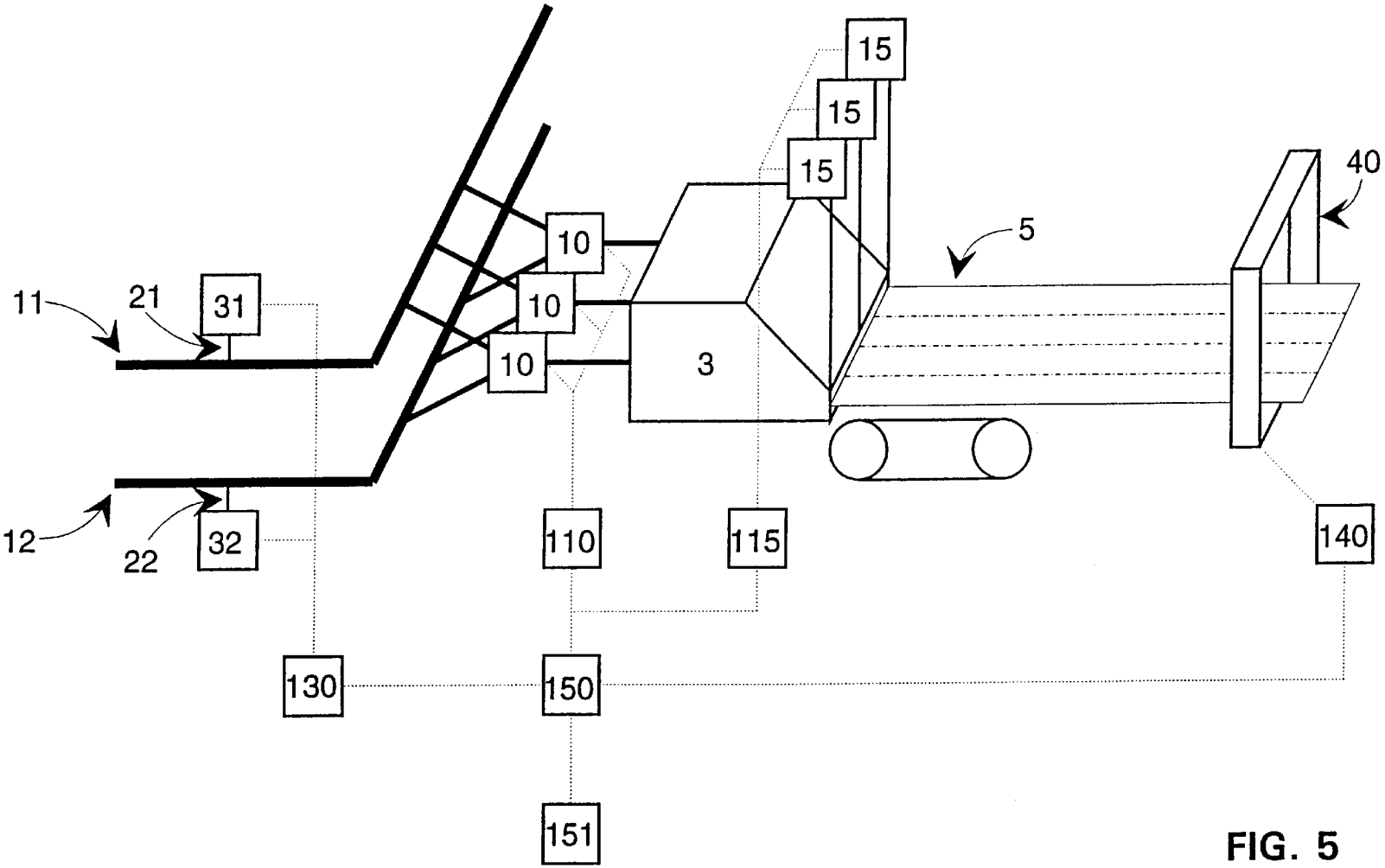
FIG. 5 schematically illustrates another embodiment of the invention, in which the slice lip of a dilution headbox is modulated in conjunction with modulation of combinatory proportions of feed streams at each feed zone.
Figure 13C:
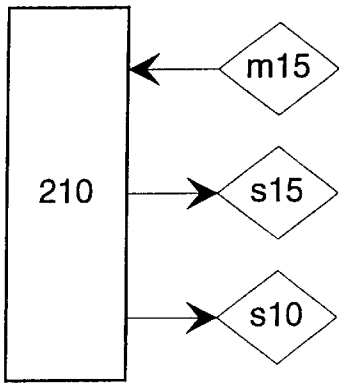
FIGS. 13*a*, 13*b*, 13*c*, and 13*d* illustrate variations on certain parts of the embodiments shown in the preceding figures.
Figure 13D:
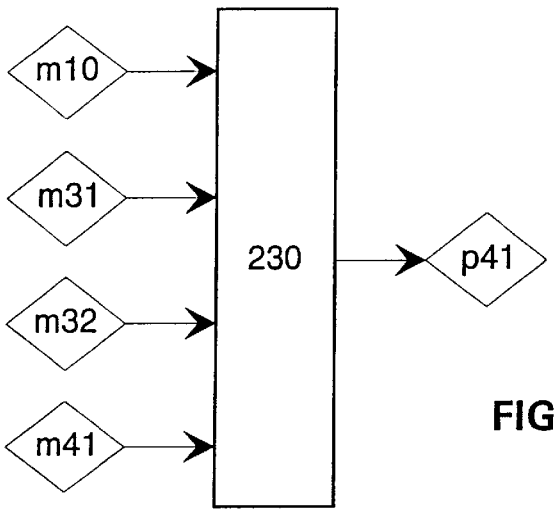

FIG. 5 schematically depicts a variation of the embodiment presented in FIG. 1, and 13*d* described above. In this embodiment, arrangements 15 are also provided for modulating the slice lip at plural locations across the web 5, i.e., slice lip profile modulating means. The arrangements 15 for modulating the slice lip of the headbox are regulated by a computer or other control instrument 115 capable of communicating with other computers or instruments. The control system 150 regulates one or more web property profiles supplied by the web measurement system 140 by modulating the combinatory proportions of the feed streams at each feed zone of the headbox 3 by means of their feed zone regulating computers or instruments 110, i.e., the actuation system, and by modulating the shape of the headbox slice lip by means of its actuation system 115, and employs in its control calculations the feed stream property measurements or factors calculated therefrom, supplied by the stream measurement system 130 for both of the streams 11, 12.

In the embodiment of FIG. 5, one or more property profiles can be regulated by the combined modulation of feed stream combinatory proportions and slice lip shape. Usually two or more property profiles are of interest, such as fiber orientation and dry weight or caliper.

Figure 6:
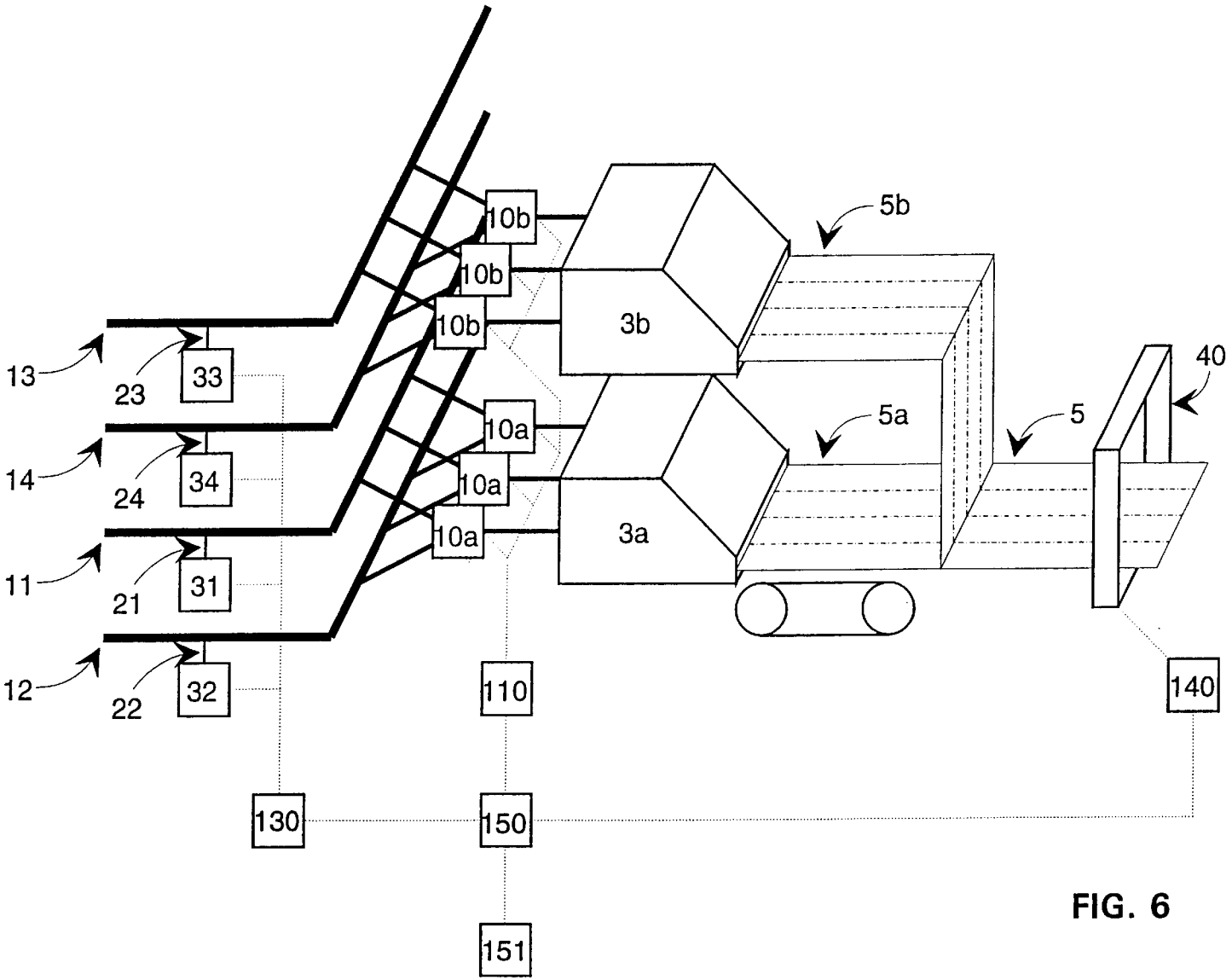
FIG. 6 schematically illustrates another embodiment of the invention, in which two dilution headboxes are supplied with two feed streams each, with their webs spliced together during manufacture.

FIG. 6 schematically depicts a variation of the embodiment presented in FIG. 1, and described above. In this embodiment, four feed streams 11, 12, 13, 14 are fed to two dilution headboxes 3*a*,3*b* equipped with independently modulated feed zones, where the webs 5*a*,5*b* produced by the headboxes 3*a*,3*b* are spliced into a single web 5 before the measurement device 40. Two feed streams 11, 12 supply the lower headbox 3*a* only, and the other two feed streams 13, 14 supply the upper headbox 3*b* only. The combinatory proportions in each feed zone in each of the two headboxes 3*a*, 3*b* is modulated by means of a suitable valve arrangement 10*a*, 10*b* for each headbox 3*a*, 3*b*. The valve arrangements 10*a*, 10*b* for the feed zones in each headbox 3*a*, 3*b* are regulated by a computer or other control instrument 110, 111 capable of communicating with other computers or instruments. The control system 150 regulates one or more web property profiles supplied by the web measurement system 140 by modulating the combinatory proportions of the feed streams at each feed zone of each layer, by means of their actuation systems (feed zone regulating computers or instruments 110, 111), and employs in its control calculations the feed stream property measurements or factors calculated therefrom, supplied by the stream measurement system 130 for the four stream measurement devices 31, 32, 33, 34. Additionally, the control system 150 may similarly modulate the combinatory proportions of headboxes 3*a*,3*b*, either of entire headboxes 3*a*,3*b* or of subdivisions of headboxes 3*a*,3*b*.

The number of headboxes may be greater than two, and not all headboxes need have a means for combining flows to their feed zones. Also, not all headboxes which have means for combining flows to their feed zones need be modulated by the web property profile regulator. The means for combining flows to feed zones in a headbox may be of equal or unequal capacity and characteristics. The number and character of feed zones and associated means may differ between headboxes, but preferably at least one headbox should have at least one layer which has at least three means for combining flows, where such means are modulated by the profile regulator.

This embodiment may be generalized to more than two headboxes, of equal or unequal characteristics, where their webs are spliced together during manufacture. Each headbox may have its own forming section, or more than one headbox may be on the same forming section. For regulation of web property profiles, multiple headboxes are analogous to a single headbox with number and type of layers equal to the sum of the actual headbox layers.

Figure 7:
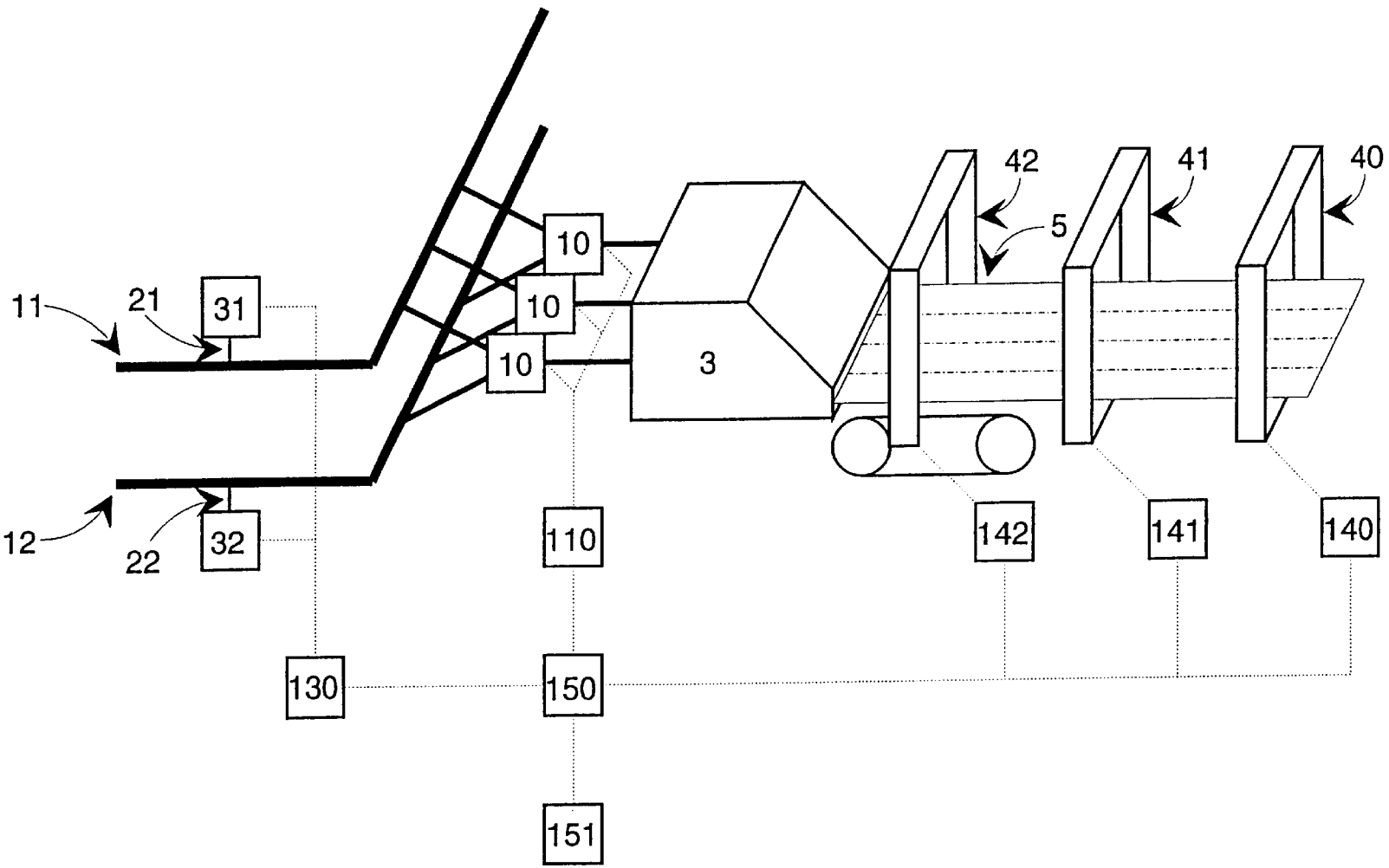
FIG. 7 schematically illustrates a variation on the embodiment shown in FIG. 1, in which the controlled web property profiles are measured at several locations in the paper machine, including a web measurement apparatus situated in the forming section.

FIG. 7 schematically depicts a variation of the embodiment presented in FIG. 1, and described above. In this variation, three web measurement devices 40, 41, 42 are deployed at different locations on the paper machine, and each is connected to a computer or other instrument 140, 141, 142 which can communicate with other computers or instruments. The control system 150 regulates one or more profiles supplied by one or more of the web measurement instruments 140, 141, 142 by modulating the combinatory proportions of the two feed streams at each feed zone, by means of the actuation system 110, and employs in its control calculations the feed stream property measurements or factors calculated therefrom, supplied by the stream measurement system 130 for both of the streams 11, 12.

The various measurement devices and systems may be embodied in a greater or lesser number of elements than shown. A web measurement device may be connected to more than one web measurement computer or instrument, and a web measurement computer or instrument may be connected to more than one web measurement device. A web measurement computer or instrument may be incorporated within a web measurement device.

Where means for measuring web property profiles are deployed at plural locations in the machine, each means may measure one, a plurality or all measured property profiles. Each measured property profile may be measured at one, a plurality or all means. Where a plurality of means each measure a plurality of web property profiles, each of the means may measure the same or a different plurality of web property profiles.

Figure 8:
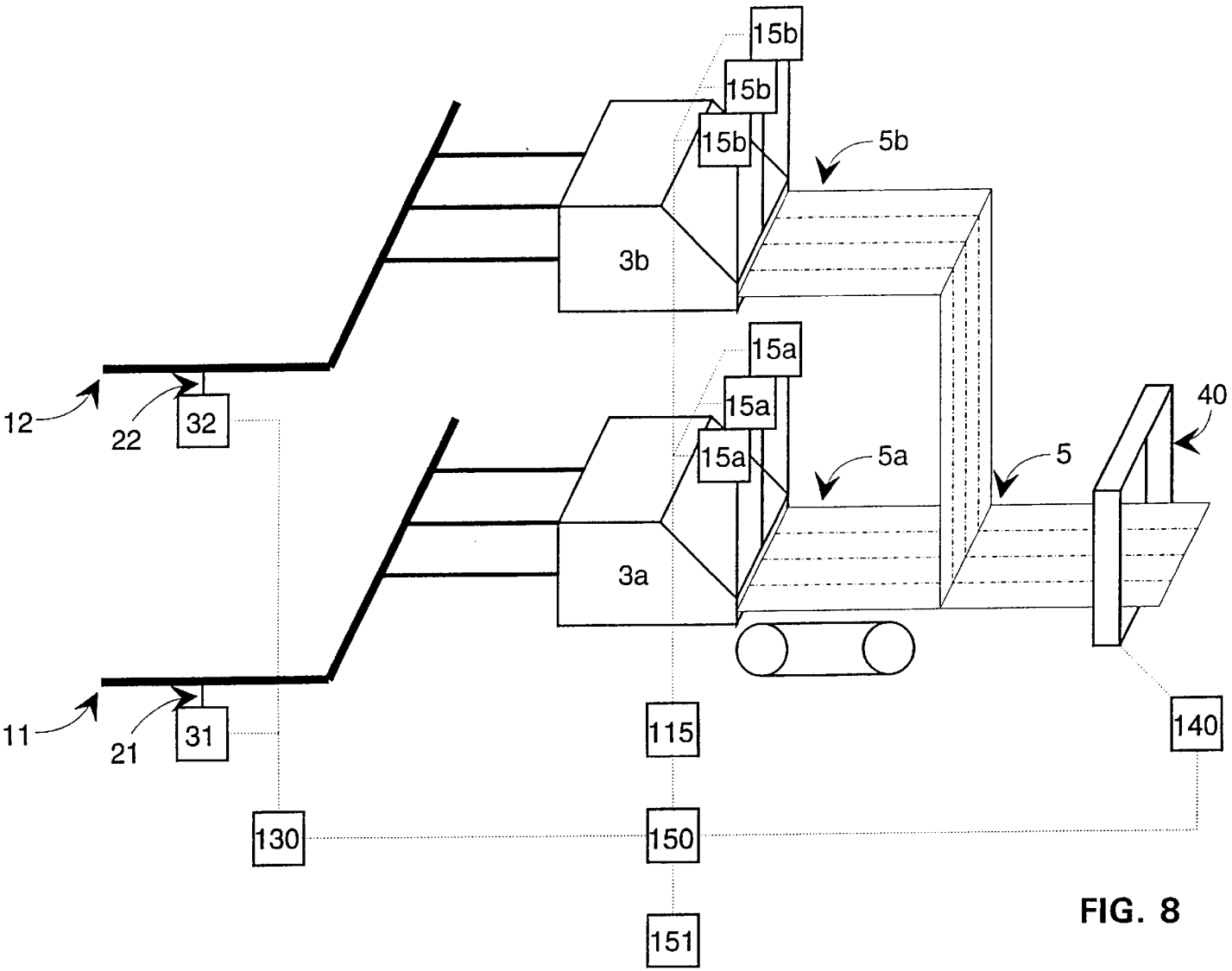
FIG. 8 schematically illustrates another embodiment of the invention, in which two conventional headboxes are supplied with different feed streams, with their webs spliced together during manufacture.

FIG. 8 schematically depicts another embodiment of the invention, in which two conventional headboxes 3*a*, 3*b* are supplied with different feed streams 11, 12. The arrangements for modulating the slice lip of each headbox are regulated by a computer or other instrument 115, 116 capable of communicating with other computers or instruments. The control system 150 regulates one or more profiles supplied by the web measurement system 140 by modulating the combinatory proportions of the feed streams at each feed zone of each layer, by means of the slice lip actuation systems 15*a*, 15*b*, 15*c*, and employs in its control calculations the feed stream property measurements or factors calculated therefrom, supplied by the feed stream measurement system 130 for the feed stream property measurement devices 31, 32. Additionally, the control system 150 may similarly modulate the combinatory proportions of headboxes, either of entire headboxes or of subdivisions of headboxes.

The number of headboxes may be greater than two, and not all headboxes need have a means for modulating their slice lips. Also, not all headboxes which have means for modulating their slice lips need be modulated by the web property profile regulator. The umber of means for modulating the slice lip may be greater than three, and may be evenly or unevenly distributed across the slice lip, and may have equal or unequal capacity across the slice lip. The number and character of means for modulating slice lips may differ between headboxes, but preferably at least one headbox should have at least three means for modulating its slice lip, where such means are modulated by the profile regulator.

The two conventional headboxes 3*a*,3*b* are, within the context of this invention, operated as if they formed a single dilution headbox, where modulating the shape of the slice lip on each headbox alters the profile of combinatory proportions of the two jets. This embodiment may be generalized to more than two headboxes, of equal or unequal characteristics, where their webs are spliced together during manufacture. For regulation of web property profiles, multiple conventional headboxes are analogous to a single dilution headbox with number and type of feed streams equal to the sum of the feed streams to the individual headboxes.

Figure 9:
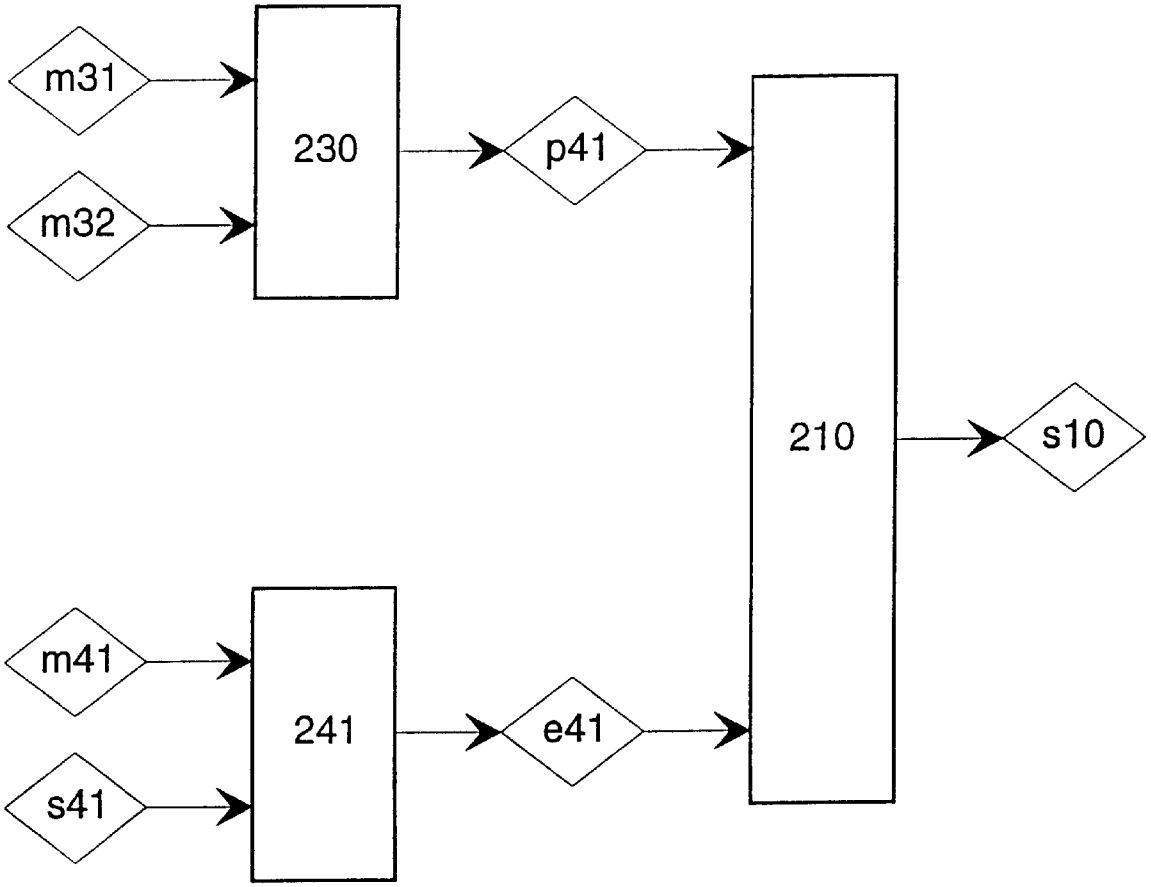
FIGS. 9, 10, 11, and 12 illustrate block diagrams for embodiments of the invention which comprise methods of regulating web properties.

FIG. 9 depicts another embodiment of the invention as a block diagram of a method for regulating a web property profile by modulating combinatory proportions of two streams to a plurality of feed zones in a dilution headbox, which uses measurements of feed stream properties in its calculations. A property measurement is provided for each of the two feed streams m31, m32. These measurements are used in a calculation 230, to produce an effective proportionality factor p41 between changes in combinatory proportions of the two feed streams and changes in the regulated web property. The web property measured profile m41 and its setpoint profile s41 are supplied to a calculation 241 which produces a web property error profile e41. The proportionality factor p41 and the web property error profile e41 are used by the profile regulation means 210 to modulate its output s10, which is normally the combinatory proportion setpoint profile, or a profile of setpoints for such means as substantially determine the combinatory proportion profile.

Only the essential elements are shown in this block diagram. The proportionality factor calculation 230 may employ other measurements and factors in addition to those shown, as may be required for the process relation between the regulated web property and the feed stream properties. The proportionality factor p41 may be a single value effective across the whole headbox, or it may be a profile of values, each effective in one or more feed zones of the headbox, or it may be a matrix of values, each effective in one or more feed zones of the headbox and in some subdivision of the web in the cross machine direction, where the number of rows in such matrix of values need not be the same as the number of columns. The proportionality factor may be supplied directly by the feed stream property measurement means. The web property profile regulator 210 may employ other measurements and factors in addition to those shown. The web property profile error calculation 241 may be contained within the regulator 210, and may utilize weighting factors or non-linear operations in addition to a simple error calculation.

The operations performed within the regulator 210 may be any commonly known algorithm for profile regulation, including, but not limited to i) an array of PID-type regulators, each governing a single feed zone or group of adjacent feed zones, with or without compensation for cross coupling between individual regulators, ii) optimization of a penalty function formed by using non-linear operations on the error profile, such as squaring and summation, where the penalty function may also include other non-linear operations on other profiles such as the combinatory proportion profile, such inclusion being by means of weighted addition, and where the optimization involves minimization by adjustment of the combinatory proportions of feed zones, and which optionally includes simulation of the resulting error profile, iii) an array of controllers employing fuzzy logic techniques, each governing a single feed zone or group of adjacent feed zones, with or without compensation for cross coupling between individual regulators, iv) an artificial neural network with inputs from inter alia the error profile and outputs to combinatory proportions, where the network has been trained, or has the capability to train itself, to adjust its outputs so that its inputs are driven towards zero. Such operations may additionally include any commonly known time domain compensation method for profiles, including but not limited to i) an array of Smith predictors and variants thereon, including variants with provision for identification of model parameters for use in prediction, ii) an array of Kalman filters.

Figure 10:
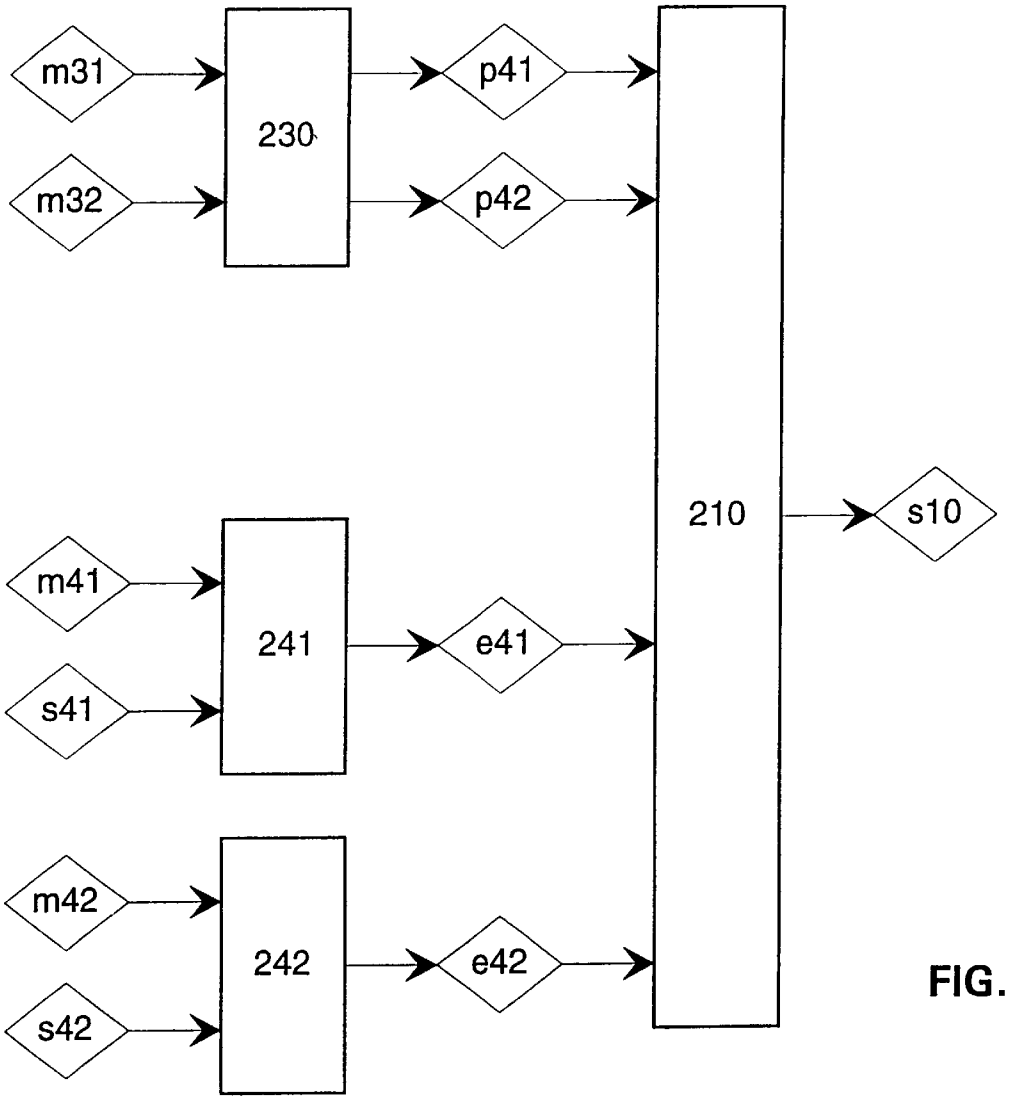

FIG. 10 depicts a variation of the embodiment presented in FIG. 9, and described above. In this embodiment, a second web property profile measurement m42 and its setpoint profile s42 are supplied to a calculation 242 which produces a second web property error profile e42. The proportionality factor calculation 230 produces a second effective proportionality factor p42, which relates changes in the combinatory proportions of the two feed streams to changes in the second profile. Both proportionality factors p41, p42 and both web property error profiles e41, e42 are used by the profile regulation means 210 to modulate its output.

The calculation methods for the second web property error profile, and for the second effective proportionality factor may differ from those for the first. The operation of the profile regulating means may be modulated by use of weight factors or similar techniques, such that the regulation of one profile takes precedence over the other, or such that the regulation effects a compromise between regulation of one or the other.

Figure 11:
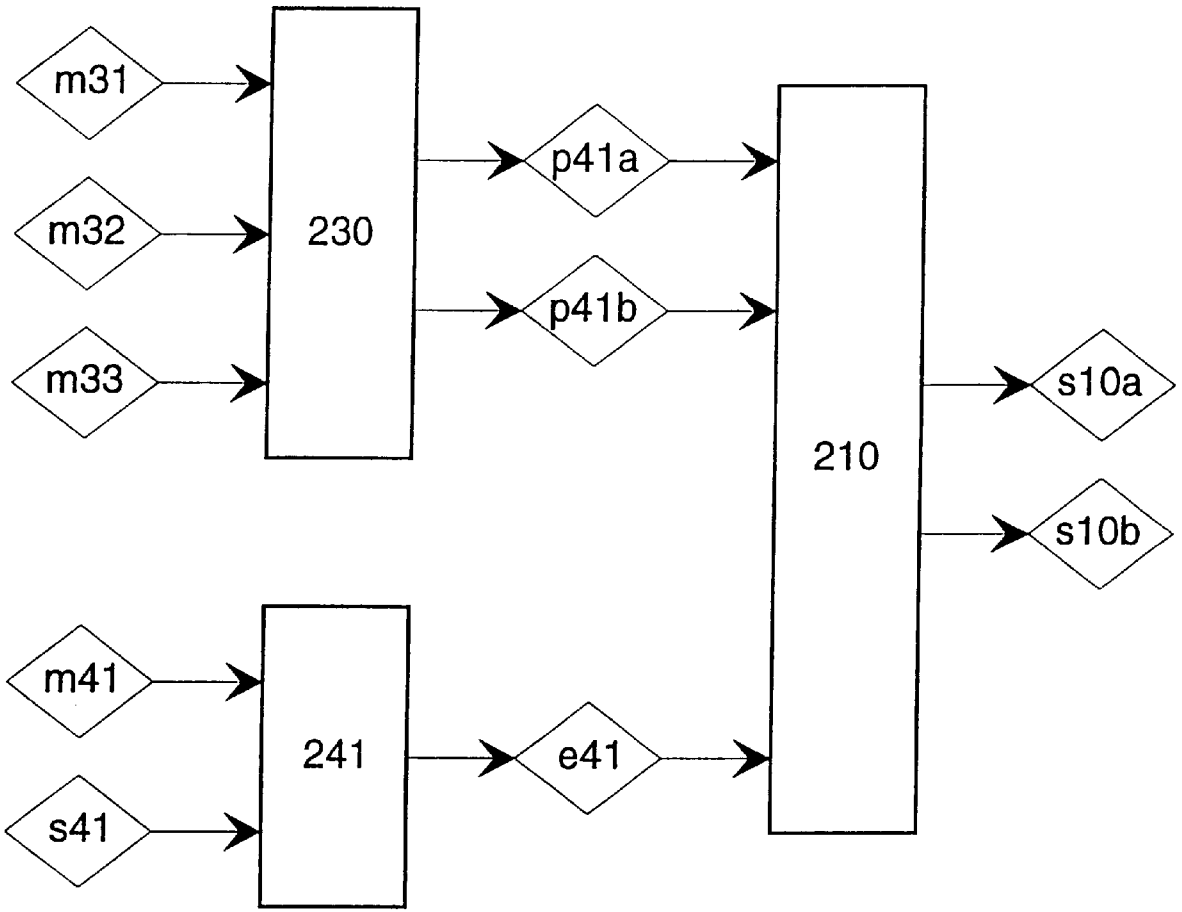

FIG. 11 depicts a variation of the embodiment presented in FIG. 9, and described above. In this embodiment, a property measurement is provided for a third feed stream m33, and supplied to a calculation 230 which produces effective proportionality factors p41*a*, p41*b*, which relate changes in the combinatory proportions of the three feed streams to changes in the regulated profile. Both proportionality factors p41*a*, p41*b* and the web property error profile e41 are used by the web property profile regulation means 210 to modulate its outputs s10*a*, s10*b*, which are normally the combinatory proportion setpoint profiles, or profiles of setpoints for such means as substantially determine the combinatory proportion profiles.

Figure 12:
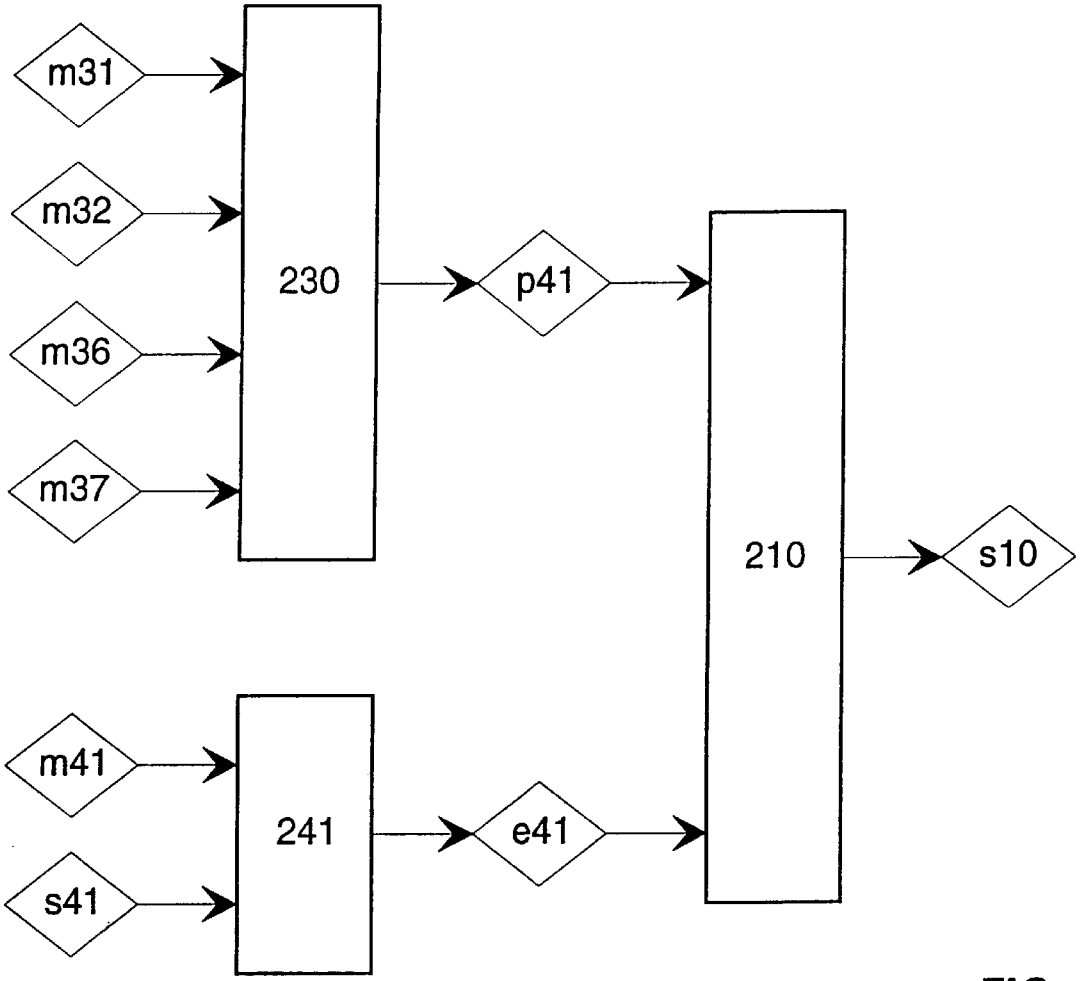

FIG. 12 depicts a variation of the embodiment presented in FIG. 9, and described above. In this embodiment, a second property measurement is provided for each of the two feed streams m36, m37 and supplied to a calculation 230, which produces the effective proportionality factor p41, which relates changes in the combinatory proportions of the two feed streams to changes in the regulated profile. The calculation 230 uses the measurements of both properties in both feed streams to produce the effective proportionality factor p41.

Figure 13A:
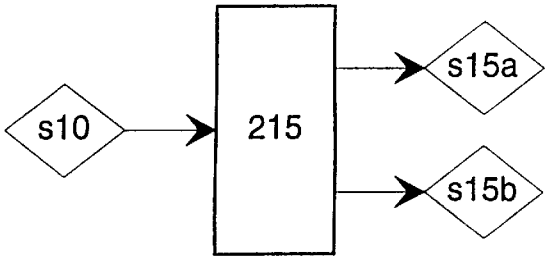

FIG. 13*a* schematically depicts a variation of the embodiment presented in FIG. 9, and described above. In this variation, a means 215 is provided for converting a combinatory proportion setpoint profile s10 into setpoint profiles for slice lips of two headboxes s15*a*, s15*b* such that the combinatory proportion profile is substantially achieved between two headboxes. Optionally, a means 225 may also be provided for calculating the prevailing combinatory proportion profile m10 from the measured slice lip profiles m15*a*, m15*b*.

The means 215 and 225 may optionally employ additional measurements and factors in their calculations.

Figure 13B:
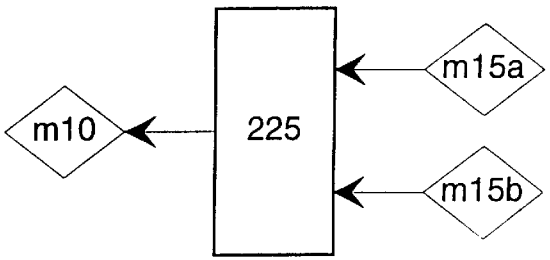
Figure 13B:
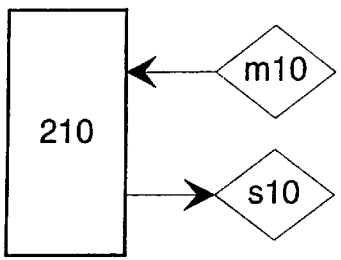

FIG. 13*b* schematically depicts a variation of the embodiment presented in FIG. 9, and described above. In this variation, the prevailing combinatory proportion profile m10 is also supplied to the web property profile regulation means 210, for use therein.

FIG. 13*c* schematically depicts a variation of the embodiment presented in FIG. 9, and described above. In this variation, the web property profile regulation means 210 modulates both the profile of combinatory proportions of the two feed streams s10, and the slice lip profile of the headbox s15. Optionally, the prevailing slice lip profile m15 is supplied to the web property profile regulation means 210, for use therein.

FIG. 13*d* schematically depicts a variation of the embodiment presented in FIG. 9, and described above. In this variation, the prevailing combinatory proportion profile m10 and the measured web property profile m41 are also supplied to the calculation 230 which may use them in calculating a profile or matrix of effective proportionality factors p41.

Other embodiments are the obvious permutations of the salient features described in these embodiments and their generalizations. For example, an immediately obvious generalization is the application of this invention to multi-layer machines with one or more dilution headboxes and one or more conventional headboxes.

In all of these embodiments, the measurement of concentrations or other properties of the feed streams allows calculation of effective proportionality factors between changes to combinatory proportions of feed streams and changes to property profiles at each subdivision of the web in the cross machine direction.

The accurate and timely calculation of such proportionality factors greatly enhances the potential effectiveness of a control system, since most control algorithms can use them advantageously. When feed stream concentrations change, the controller can adjust combinatory proportions of feed streams to the headbox feed zones to compensate for those changes before any adverse effects occur in the regulated properties of the web.

Furthermore, accurate knowledge of such proportionality factors allows more precise modulation of combinatory proportions of feed streams to the headbox feed zones. Since the effect of a modulation is accurately known, a controller can make exact rather than approximate control corrections, both in response to a process disturbance and in response to a change in target.

Example of Proportionality Factor

As one example, the effective proportionality factor between a web property W (such as dry weight or ash weight), whose value is $W_i$ at a subdivision i of the web in the cross machine direction, and the combinatory proportion $K_j$ of two feedstreams to feed zone j of the headbox, where the constituent (such as total consistency or ash consistency) influencing the property has measured concentration $C_D$ in the stream whose proportion is $K_j$ and measured concentration $C_S$ in the stream whose proportion is $1\text{-}K_j$ may be calculated as:

$$\frac{\partial W_i}{\partial K_j} = \frac{R_{ji}(C_D - C_S)W_i}{C_D K_j + C_S(1 - K_j)}$$

where $R_{ji}$ is a coefficient indicating the degree of influence of feed zone j of the headbox over a property in subdivision i of the web. The formulation expressed above defines a matrix of proportionality values, each effective for a single headbox feed zone and a single subdivision of the web. Other formulations may be used to relate properties such as opacity, brightness, or color of the web to $TiO_2$ concentration in or brightness or color of the feed streams. Similarly, other formulations may be used to relate other properties of the web to pertinent properties of the feed streams.

Summary

Whereas in the embodiments and drawings, particular variations of the invention are illustrated and described, it should be understood that the invention is not restricted to the embodiments and variants presented. Its applicability extends to other combinations of the features presented in the embodiments and drawings. Its applicability extends to obvious generalizations of the particulars presented. Its applicability extends beyond any particular arrangements of computers, communication lines, and other equipment which can vary freely between realizations of the invention. Its applicability extends to regulation of one or more web property profiles by means for modulating other cross machine actuation systems in addition to modulating the feed stream proportion profile.

A novelty of the invention is thus the use of means for sampling two or more feed streams to a headbox as described above, with means for measuring properties of those samples as described above, and in the use of the measured properties or factors calculated therefrom in any means for modulating the plural combinatory proportions of the aforesaid feed streams to feed zones of the headbox, and especially in the use of those measured properties or factors calculated therefrom in any means for regulating one or more web property profiles which modulates the aforesaid combinatory proportions.

The above described embodiments, variants, drawings, modes of operation, and other particulars should be regarded as illustrative, rather than restrictive, and it should be appreciated that variations may be made by workers skilled in the art without departing from the scope of the present invention.

We claim:

1. An apparatus for controlling a cross-direction profile of at least one property of a paper web manufactured by a paper machine, comprising a first headbox for receiving at least two different feed streams and discharging a pulp suspension formed from said at least two feed streams to thereby form a web, said first headbox having separated cross-machine sections defining separate feed zones, first supply means for supplying said at least two feed streams to said first headbox such that each of said at least two feed streams is directed into a plurality of said feed zones of said first headbox and each of said feed zones is supplied with a combination of at least two of said at least two feed streams, each of said at least two feed streams containing feedstuffs for the paper to be manufactured suspended in aqueous solution, control means for regulating said first headbox, first measurement means coupled to said control means for measuring the profile of the at least one property, generating a first measurement signal based thereon, and directing said first measurement signal to said control means, said first measurement means being arranged at a location downstream of said first headbox, sampling means for obtaining samples of said at least two feed streams from a location upstream of said first headbox continuously or at intervals, second measurement means for measuring at least one property of said samples of said at least two feed streams, generating a second measurement signal based thereon, and directing said second measurement signal to said control means, and regulation means for regulating the supply of said at least two feed streams into each of a plurality of said feed zones of said first headbox, said regulation means being controlled by said control means, said control means being structured and arranged to control said regulation means based on said first and second measurement signals to thereby regulate the supply of said at least two feed streams being fed into each of said plurality of said feed zones of said first headbox.

2. The apparatus of claim 1, wherein said first supply means are structured and arranged to supply said at least two feed streams to said first headbox such that each of said at least two feed streams is directed into each of said feed zones of said first headbox, said first supply means comprising an arrangement of valves, one of said valves being associated with each of said feed zones, said valves being regulated by said regulation means.

3. The apparatus of claim 1, wherein said sampling means comprise a first sampling arrangement for obtaining samples from a first one of said at least two feed streams and a second sampling arrangement for obtaining samples from a second one of said at least two feed streams, said measurement means comprising a first measuring device for measuring the at least one property in said samples from said first feed stream and a second measuring device for measuring the at least one property in said samples from said second feed stream, said first and second measuring devices being connected to said control means.

4. The apparatus of claim 1, wherein said sampling means comprise a first sampling arrangement for obtaining samples from one of said at least two feed streams at a first location upstream of said first headbox and a second sampling arrangement for obtaining samples from said one of said at least two feed streams at a second location upstream of said first headbox and different than said first location, said measurement means comprising a first measuring device associated with said first sampling arrangement for measuring the at least one property in said samples from said first feed stream obtained at said first location and a second measuring device associated with said second sampling arrangement for measuring the at least one property in said samples from said second feed stream obtained at said second location, said first and second measuring devices being connected to said control means.

5. The apparatus of claim 1, wherein said sampling means comprise a sampling arrangement for obtaining samples from one of said at least two feed streams, said measurement means comprising a first measuring device associated with said sampling arrangement for measuring the at least one property in said samples from said first feed stream and a second measuring device associated with said sampling arrangement for measuring the at least one property in said samples from said first feed stream obtained at said second location, said first and second measuring devices being connected to said control means.

6. The apparatus of claim 1, wherein said first headbox has a slice lip, further comprising modulating means for modulating said slice lip of said first headbox at a plurality of locations across a width of the web, second regulation means for controlling said modulating means, said control means being structured and arranged to control said second regulation means.

7. The apparatus of claim 1, wherein said first headbox is a dilution headbox, a first one of said at least two feed streams being a stock suspension and a second one of said at least two feed streams being a dilution medium having a concentration lower than a concentration of the stock suspension.

8. For use in a sheetmaking process, and particularly in the manufacture of a continuous paper web, an apparatus comprising in combination:

(i) a first headbox including at least one layer of at least three feed zones in a cross machine direction and being arranged to discharge a pulp suspension jet which will form the web, (ii) first supply means for supplying a plurality of feed streams to each of said at least three feed zones in said at least one layer of feed zones in said first headbox, (iii) first modulating means for independently modulating a combination of said feed streams being supplied to each of said at least three feed zones in said at least one layer;

(iv) first sampling means for obtaining samples of said feed streams at a location upstream of said first headbox;

(v) first measurement means of measuring at least one property of said samples of said feed streams;

(vi) second measurement means for measuring at least one property of the web at a plurality of locations in the cross machine direction downstream of said first headbox; and (vii) regulating means coupled to said first measurement means and said second measurement means for regulating the profile of the at least one property of the web by controlling said first modulating means of said at least one layer based on the measurement of the at least one property of said samples of said feed streams and the measurement of the at least one property of the web downstream of said first headbox.

9. The apparatus of claim 8, wherein said first sampling means and said first measurement means constitute an element arranged in an exposed position within each of said feed streams.

10. The apparatus of claim 8, wherein said first headbox has a slice lip, further comprising second modulating means for modulating said slice lip of said first headbox at a plurality of locations across a width of the web, said regulating means being structured and arranged to regulate said second modulating means based on the measurement of the at least one property of said samples of said feed streams and the measurement of the at least one property of the web downstream of said first headbox.

11. The apparatus of claim 8, wherein said second measurement means are arranged in a forming section of the paper machine such that said second measurement means are structured and arranged to measure the at least one property of the web immediately after discharge from said first headbox or while the web is only partially formed.

* * * * *

UNITED STATES PATENT AND TRADEMARK OFFICE

CERTIFICATE OF CORRECTION

PATENT NO. : 6,491,792 B2 
DATED : December 10, 2002
INVENTOR(S) : Shakespeare, John Francis et al.

It is certified that error appears in the above-identified patent and that said Letters Patent is hereby corrected as shown below:

Title page,
Item [73], Assignee "Metsuo Paper, Inc. Heksinki (FI)" should read -- Metso Paper, Inc. Helsinki (FI) --.

Signed and Sealed this

Twenty-fifth Day of March, 2003

JAMES E. ROGAN
*Director of the United States Patent and Trademark Office*